US006215052B1

(12) United States Patent
Giddens et al.

(10) Patent No.: US 6,215,052 B1
(45) Date of Patent: Apr. 10, 2001

(54) GUITAR PICK HOLDER

(76) Inventors: Michael Giddens, P.O. Box 1164, Brea, CA (US) 92822; Raymond Dickinson, 117 E. Ridge Dr., San Ramon, CA (US) 94583; Wolfgang Ott, 1410 Creekside Dr., #17, Walnut Creek, CA (US) 94596

( * ) Notice: Subject to any disclaimer, the term of this patent is extended or adjusted under 35 U.S.C. 154(b) by 0 days.

(21) Appl. No.: 09/579,681

(22) Filed: May 26, 2000

(51) Int. Cl.[7] ..... G10D 3/00

(52) U.S. Cl. ..... 84/329; 84/320; 84/322; 211/120

(58) Field of Search ..... 84/329, 320, 322, 84/321, 453; D17/99; 211/120

(56) References Cited

U.S. PATENT DOCUMENTS

| | | | | |
|---|---|---|---|---|
| D. 309,674 | | 8/1990 | Gervase . | |
| D. 355,667 | | 2/1995 | Burger . | |
| 4,135,431 | | 1/1979 | Ferguson . | |
| 4,467,693 | * | 8/1984 | Nasfell, Jr. | 84/329 |
| 4,785,708 | | 11/1988 | Vaughan . | |
| 4,890,531 | | 1/1990 | Tischer . | |
| 5,127,300 | | 7/1992 | Silverman . | |
| 5,231,238 | | 7/1993 | Adams . | |
| 5,649,634 | * | 7/1997 | Irizarry | 211/120 |
| 5,796,021 | | 8/1998 | Longshore . | |
| 6,140,564 | * | 10/2000 | Pia | 84/453 |

* cited by examiner

*Primary Examiner*—Shih-Yung Hsieh
(74) *Attorney, Agent, or Firm*—Jack Lo

(57) ABSTRACT

The present guitar pick holder comprises a housing formed of a front half and a back half. A plurality of slots are arranged on the front half for receiving guitar picks. The slots are positioned very close together and staggered for compactness, but still enable the picks to be easily gripped. The picks may be randomly selected and removed from any slot. Each slot includes a beveled first edge for aiding pick insertion. A resilient tab projects into the slot from the first edge for securing the pick in position. A plurality of ramps are attached to the interior of the back half of the housing and aligned behind the slots. When a guitar pick is inserted into a slot, it is biased by the resilient tab against a second edge of the slot to an angled position relative to the surface of the housing for being easily gripped. The angle is limited by the ramp which engages the inner end of the pick. A clip on the back half of the housing is for clipping to a guitar strap or belt.

19 Claims, 3 Drawing Sheets

GUITAR PICK HOLDER

BACKGROUND OF THE INVENTION

1. Field of the Invention

This invention relates generally to guitar pick holders.

2. Prior Art

A guitar pick is an egg shaped, springy sheet for plucking guitar strings. Many musicians have a collection of guitar picks in different sizes and thickness. Keeping them loosely in a bag or a box makes finding the desired pick a difficult and annoying task. They are also so small that they are easily lost.

Various holders are known in the prior art for storing and dispensing guitar picks. U.S. Pat. No. 5,796,021 to Longshore discloses a pick holder which comprises a block with a slot where a pick can be inserted. The slot is only wide enough to hold a single pick. U.S. Pat. No. 5,231,238 to Adams discloses a pick dispenser similar to a coin dispenser. The picks can only be accessed sequentially. U.S. Pat. No. 5,127,300 to Silverman discloses a pick holder which comprises an elongated clip into which a plurality of picks can be inserted. The clip must be inconveniently long to hold many picks. U.S. Pat. No. 4,890,531 to Tischer discloses a pick holder comprising a coil spring into which picks can be inserted. The spring tends to stretch when a pick is removed and causes other picks to fall out.

U.S. Pat. No. 4,785,708 to Vaughan discloses a pick holder which comprises a series of side-by-side pockets. The holder is for attaching to the body of a guitar. The picks are held parallel and very close to the surface of the guitar, so that they tend to be difficult to grip and remove. U.S. Pat. No. 4,135,431 to Ferguson shows a spring loaded pick dispenser similar to a coin dispenser, wherein the picks can only be accessed sequentially. U.S. patent Des. 355,667 to Burger shows a pick holder which comprises a plurality of side-by-side spring loops for attaching to the tuning pegs on the neck of a guitar. The holder tends to interfere with the operation of the tuning pegs. U.S. patent Des. 309,674 to Gervase discloses a pick holder which comprises a rail with a clip for clipping to a guitar strap or belt. This holder also limits the picks to being accessed sequentially. Many of the prior art guitar pick holders are attached to the guitar body. However, many musicians are reluctant to tape or otherwise attach anything to their guitars.

OBJECTIVES OF THE INVENTION

Accordingly, the objectives of the present guitar pick holder are:

to hold guitar picks securely to prevent loss;

to hold a collection of guitar picks in a very compact space;

to enable the guitar picks to be easily gripped and removed;

to enable the guitar picks to be randomly selected and removed;

to hold guitar picks of different sizes and thickness; and to attach the guitar picks to a strap or belt so as not to mar the guitar.

Further objectives of the present invention will become apparent from a consideration of the drawings and ensuing description.

BRIEF SUMMARY OF THE INVENTION

The present guitar pick holder comprises a housing formed of a front half and a back half. A plurality of slots are arranged on the front half for receiving guitar picks. The slots are positioned very close together and staggered for compactness, but still enable the picks to be easily gripped. The picks may be randomly selected and removed from any slot. Each slot includes a beveled first edge for aiding pick insertion. A resilient tab projects into the slot from the first edge for securing the pick in position. A plurality of ramps are attached to the interior of the back half of the housing and aligned behind the slots. When a guitar pick is inserted into a slot, it is biased by the resilient tab against a second edge of the slot to an angled position relative to the surface of the housing for being easily gripped. The angle is limited by the ramp which engages the inner end of the pick. A clip on the back half of the housing is for clipping to a guitar strap or belt.

DRAWING REFERENCE NUMERALS

10. Housing
11. Front Half
12. Back Half
13. Slots
14. First Edge
15. Second Edge
16. Resilient Tab
17. Cuts
18. Concave Tip
19. Ramp
20. Slanted Edge
21. Outer End
22. Inner End
23. Clip
24. Loop
25. Guitar Pick

DETAILED DESCRIPTION OF THE INVENTION

Figure 1:
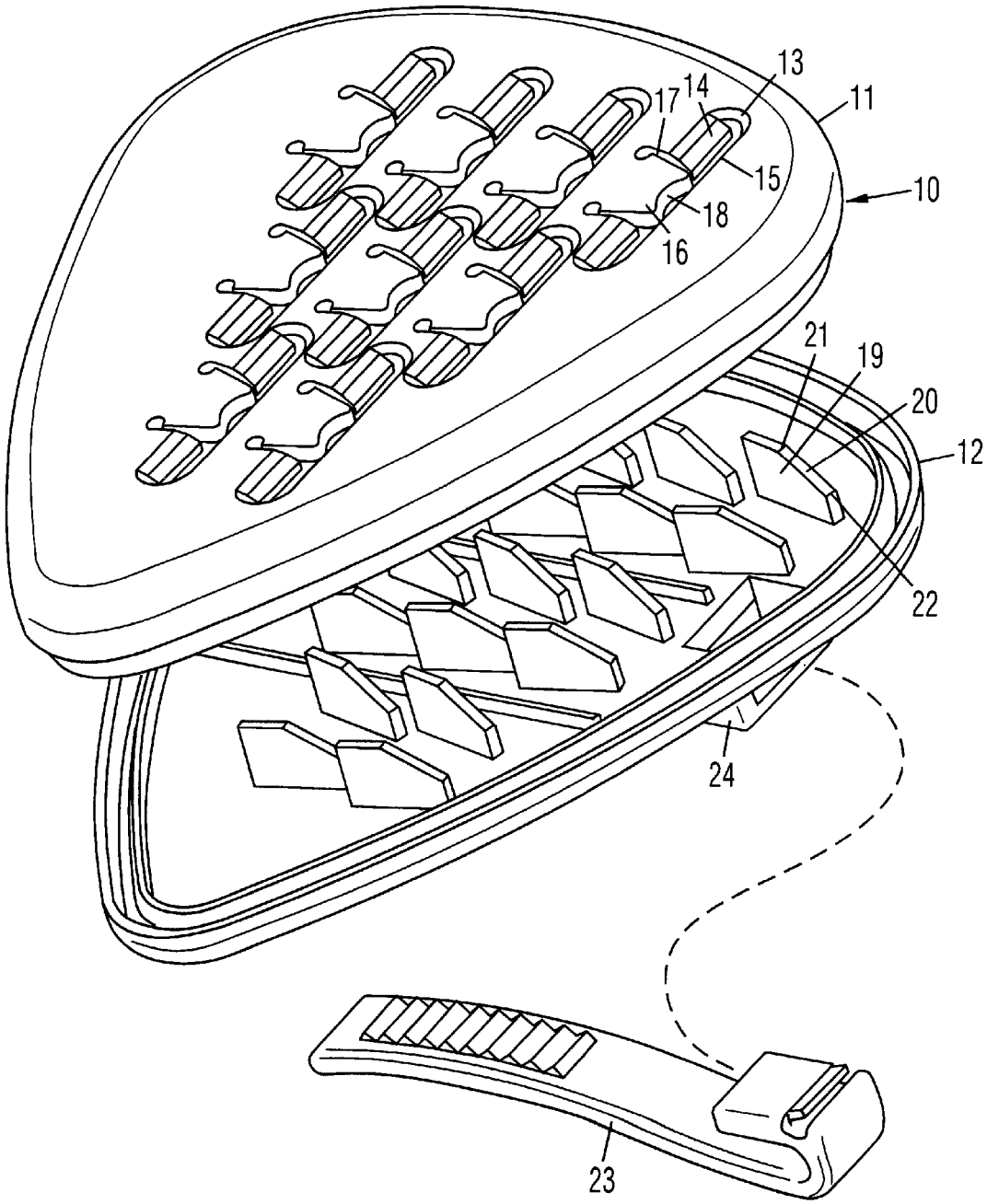
FIG. 1 is a front perspective exploded view of the present guitar pick holder.

FIG. 1:

A preferred embodiment of the present guitar pick holder is shown in a front perspective view in FIG. 1. It comprises a housing 10 formed of a front half 11 and a back half 12. Housing 10 is preferably in the shape of a guitar pick for clearly identifying its use. A plurality of slots 13 are arranged on front half 11 for receiving guitar picks. Each slot 13 includes a first edge 14 and a second edge 15. First edge 14 is beveled for aiding pick insertion. A resilient tab 16 projects into slot 13 from first edge 14. Tab 16 is preferably coplanar and integral with the face of front half 11 for being easily molded. The entire front half 11 is thus preferably molded of a resilient material. A pair of cuts 17 on either side of tab 16 extend away from slot 13. Cuts 17 extend the length of tab 16 to provide enough springiness. A concave tip 18 is provided on tab 16.

A plurality of ramps 19 are attached to the interior of back half 12 of housing 10. A pair of ramps 19 are positioned under each slot 13, but more or fewer ramps can be provided. Each ramp 19 includes a slanted edge 20. Slanted edge 20 has an outer end 21 for aligning with slot 13, and an inner end 22 extending in the same general direction as tab 16. A strap or belt clip 23 is for attaching to a loop 24 on back half 12 of housing 10.

Figure 2:
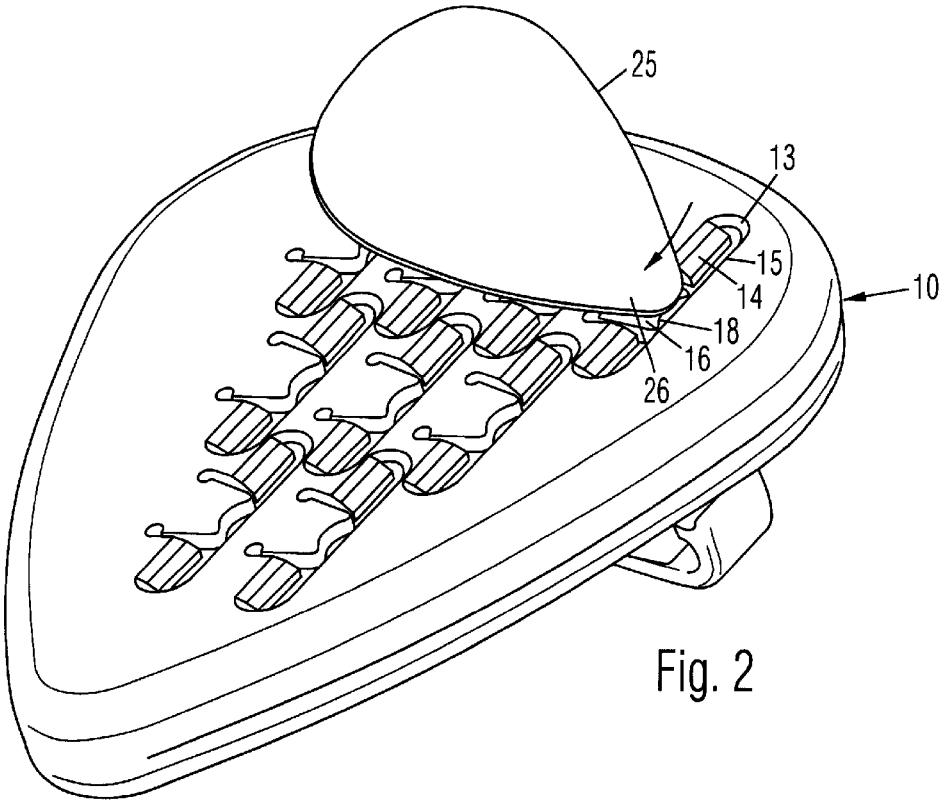
FIG. 2 is a front perspective view of the holder assembled, and a guitar pick is being inserted into a slot.
Figure 3:
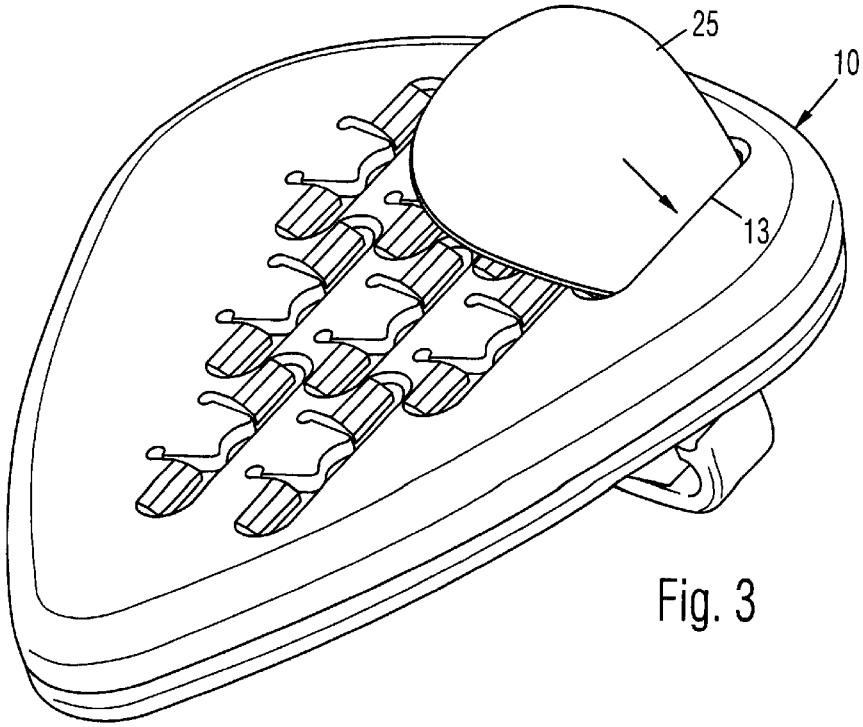
FIG. 3 is a front perspective view of the holder with the guitar pick fully inserted.

FIGS. 2–3:

Housing 10 is shown fully assembled in FIG. 2. A guitar pick 25 is being inserted into a slot 13. A smaller end 26 of guitar pick 25 is positioned against concave tip 18 on tab 16. Guitar pick 25 is pressed against tab 16 to push it inward and allow smaller end 26 to dive under second edge 15 of slot 13. Guitar pick 25 is shown fully inserted into slot 13 in FIG. 3.

Figure 4:
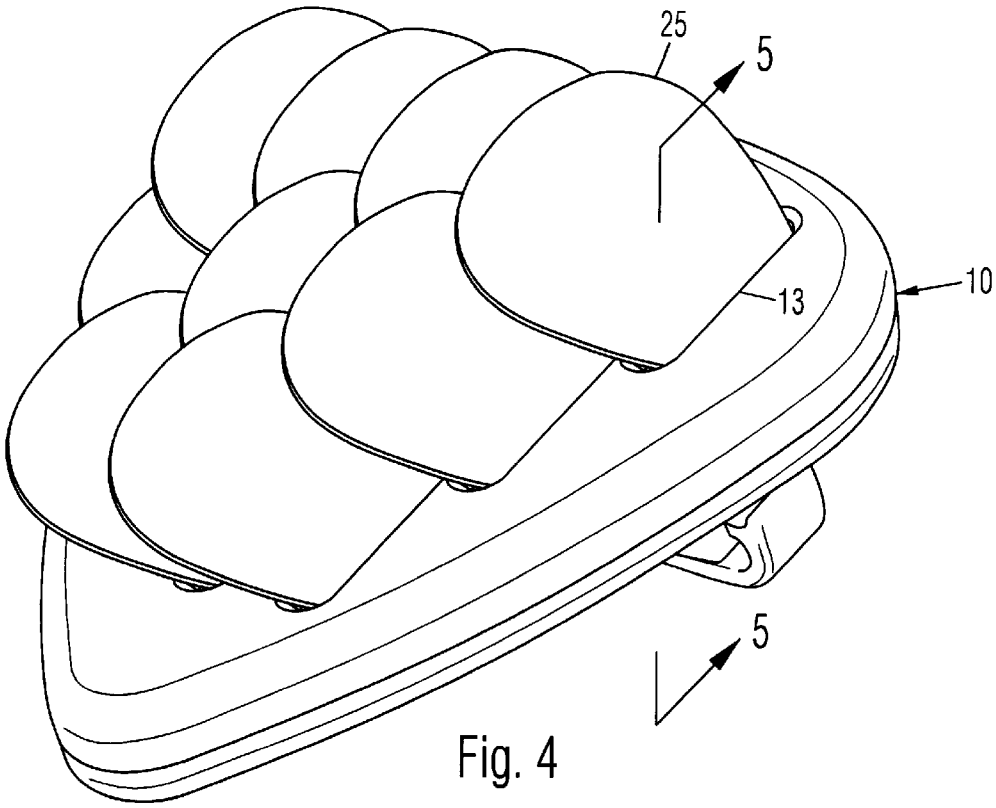
FIG. 4 is a front perspective view of the holder full with guitar picks.

FIGS. 4–5:

The holder is shown in FIG. 4 filled with guitar picks 25. Slots 13 are positioned very close to each other and staggered for maximum compactness, but still enable guitar picks 25 to be easily gripped and removed. A collection of guitar picks 25 are thus secured in the holder, and can be randomly selected for removal. Slots 13 are arranged in a plurality of rows for minimizing the width of the holder, wherein each row has a plurality of parallel slots. Slots 13 are long and wide enough for holding picks of different sizes and thickness.

Figure 5:
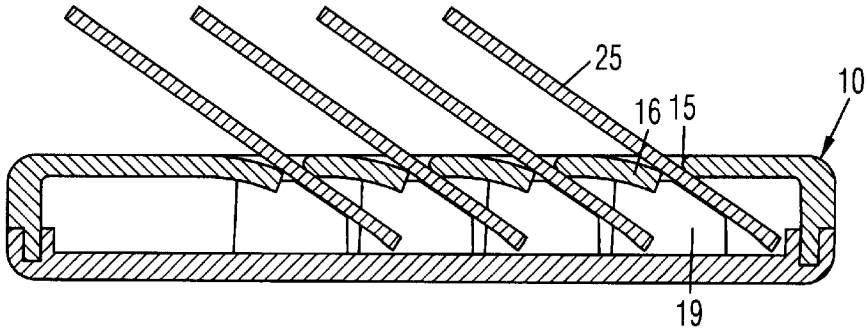
FIG. 5 is a sectional view of the holder along line 5—5 in FIG. 4.

In FIG. 5, each guitar pick 25 is biased by resilient tab 16 against second edge 15 of slot 13. Second edge 15 acts as a fulcrum to rotate guitar pick 25 to a sharply angled position relative to the surface of housing 10 for being easily gripped. The angle is limited by ramp 19 which engages an inner end of guitar pick 25.

SUMMARY AND SCOPE

Accordingly, the present guitar pick holder holds a plurality of guitar picks securely to prevent loss. It holds the guitar picks in a very compact space. It enables the guitar picks to be easily gripped and removed. It enables the guitar picks to be randomly selected and removed. It holds guitar picks of different sizes and thickness. It also attaches the guitar picks to a strap or belt so as not to mar the guitar.

Although the above description is specific, it should not be considered as a limitation on the scope of the invention, but only as an example of the preferred embodiment. Many variations are possible within the teachings of the invention. Therefore, the scope of the invention should be determined by the appended claims and their legal equivalents, not by the examples given.

We claim:

1. A guitar pick holder, comprising:

a housing with a front and a back;

a plurality of slots arranged on said front of said housing for receiving a plurality of guitar picks, wherein each of said slots includes a first edge and a second edge;

a resilient tab projecting into each of said slots from said first edge for engaging and holding a corresponding guitar pick; and a pair of cuts on said first edge of each of said slots, wherein said cuts are on either side of said resilient tab and extend away from said first edge, said cuts increasing a length of said resilient tab to provide improved springiness.

2. The guitar pick holder of claim 1, wherein said slots are staggered relative to each other for compactness and still enable said guitar picks to be gripped and removed, said slots hold a collection of said guitar picks which are randomly selectable for removal.

3. The guitar pick holder of claim 1, wherein said resilient tab is integral with said front of said housing, and said front of said housing is entirely molded of a resilient material for convenient manufacturing.

4. The guitar pick holder of claim 1, wherein housing is guitar pick shaped for clearly identifying an intended use thereof.

5. The guitar pick holder of claim 1, wherein said slots are arranged in a plurality of rows each with a plurality of said slots for minimizing a width of said holder.

6. The guitar pick holder of claim 1, further including a concave tip on a distal end of said resilient tab for engaging a tip of a corresponding guitar pick, wherein said resilient tab is adapted to be depressed by said corresponding guitar pick during insertion.

7. The guitar pick holder of claim 1, further including a belt clip on said back of said housing.

8. A guitar pick holder, comprising:

a housing with a front and a back;

a plurality of slots arranged on said front of said housing for receiving a plurality of guitar picks, wherein each of said slots includes a first edge and a second edge;

a plurality of ramps positioned inside said housing, wherein at least one of said ramps is positioned under each of said slots for supporting each of said guitar picks in a slanted position relative to said front of said housing for being conveniently gripped.

9. The guitar pick holder of claim 8, wherein said slots are staggered relative to each other for compactness and still enable said guitar picks to be gripped and removed, said slots hold a collection of said guitar picks which are randomly selectable for removal.

10. The guitar pick holder of claim 9, wherein housing is guitar pick shaped for clearly identifying an intended use thereof.

11. The guitar pick holder of claim 9, wherein said slots are arranged in a plurality of rows each with a plurality of said slots for minimizing a width of said holder.

12. The guitar pick holder of claim 9, further including a belt clip on said back of said housing.

13. A guitar pick holder, comprising:

a housing with a front and a back;

a plurality of slots arranged on said front of said housing for receiving a plurality of guitar picks, wherein each of said slots includes a first edge and a second edge;

a resilient tab projecting into each of said slots from said first edge;

a pair of cuts on said first edge of each of said slots, wherein said cuts are on either side of said resilient tab and extend away from said first edge, said cuts increasing a length of said resilient tab to provide improved springiness;

a plurality of ramps positioned inside said housing, wherein at least one of said ramps is positioned under each of said slots for supporting each of said guitar picks in a slanted position relative to said front of said housing for being conveniently gripped;

wherein each of said guitar picks is biased by said resilient tab against said second edge of each of said slots, said second edge serving as a fulcrum to rotate each of said guitar picks to said slanted position, an angle of said slanted position is limited by said ramp which engages an inner end of each of said guitar picks.

14. The guitar pick holder of claim 13, wherein said slots are staggered relative to each other for compactness and still enable said guitar picks to be gripped and removed, said slots hold a collection of said guitar picks which are randomly selectable for removal.

15. The guitar pick holder of claim 13, wherein said resilient tab is integral with said front of said housing, and said front of said housing is entirely molded of a resilient material for convenient manufacturing.

16. The guitar pick holder of claim 13, wherein housing is guitar pick shaped for clearly identifying an intended use thereof.

17. The guitar pick holder of claim 13, wherein said slots are arranged in a plurality of rows each with a plurality of said slots for minimizing a width of said holder.

18. The guitar pick holder of claim 13, further including a concave tip on a distal end of said resilient tab for engaging a tip of a corresponding guitar pick, wherein said resilient tab is adapted to be depressed by said corresponding guitar pick during insertion.

19. The guitar pick holder of claim 13, further including a belt clip on said back of said housing.

* * * * *